US010001092B2

(12) United States Patent
Soeda et al.

(10) Patent No.: US 10,001,092 B2
(45) Date of Patent: Jun. 19, 2018

(54) AIR CLEANER FOR MOTORCYCLE

(71) Applicant: Kawasaki Jukogyo Kabushiki Kaisha, Kobe-shi, Hyogo (JP)

(72) Inventors: Akira Soeda, Kobe (JP); Yota Katsukawa, Himeji (JP); Yoshitaka Awazu, Kakogawa (JP); Satoshi Matsumoto, Kobe (JP); Kenta Matsubara, Kobe (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 161 days.

(21) Appl. No.: 14/945,281

(22) Filed: Nov. 18, 2015

(65) Prior Publication Data

US 2016/0069306 A1 Mar. 10, 2016

Related U.S. Application Data

(63) Continuation of application No. PCT/JP2014/058697, filed on Mar. 26, 2014.

(30) Foreign Application Priority Data

May 27, 2013 (JP) ..... 2013-110629

(51) Int. Cl.
*F02M 35/024* (2006.01)
*F02M 35/16* (2006.01)

(52) U.S. Cl.
CPC .... *F02M 35/02416* (2013.01); *F02M 35/162* (2013.01); *F02M 35/02433* (2013.01); *F02M 35/02491* (2013.01)

(58) Field of Classification Search
CPC ..... F02M 35/02416; F02M 35/162; F02M 35/0201; F02M 35/048; F02M 35/02925;
(Continued)

(56) References Cited

U.S. PATENT DOCUMENTS 4,509,613 A * 4/1985 Yamaguchi ..... B62J 35/00 180/219
6,251,151 B1 * 6/2001 Kobayashi ..... F02B 61/02 123/198 E (Continued)

FOREIGN PATENT DOCUMENTS

CN 101600867 12/2009
CN 201367965 12/2009

(Continued)

OTHER PUBLICATIONS

English Translation of the International Preliminary Report on Patentability and Written Opinion of the International Searching Authority dated Dec. 10, 2015 for International PCT Patent Application No. PCT/JP2014/058697, filed Mar. 26, 2014 (14 pages).

(Continued)

*Primary Examiner* — Stephen K Cronin
*Assistant Examiner* — Kody Kight

(57) ABSTRACT

An air cleaner mounted on a motorcycle for purifying an engine intake air includes a lower casing forming a cleaner main body, a covering for covering an upward region of the lower casing, a cleaner element disposed inside the lower casing and positioned below a mating interface between the lower casing and the covering, and a partition wall formed in the lower casing for supporting the cleaner element and forming a part of a wall of a clean chamber.

7 Claims, 5 Drawing Sheets

(58) Field of Classification Search
CPC ..... F02M 35/02475; F02M 35/02491; F02M 35/02433
USPC ..... 123/198 E
See application file for complete search history.

(56) References Cited

U.S. PATENT DOCUMENTS

| | | | | |
|---|---|---|---|---|
| 6,349,690 | B2 | 2/2002 | Utsumi et al. | |
| 6,382,196 | B2 | 5/2002 | Kawamoto et al. | |
| 6,609,367 | B2 * | 8/2003 | Nakayasu | F01N 3/28 137/625.19 |
| 7,066,135 | B2 * | 6/2006 | Ishikawa | F02M 35/10039 123/198 E |
| 7,614,380 | B2 * | 11/2009 | Tsutsui | F02M 35/10295 123/184.57 |
| 7,637,242 | B2 * | 12/2009 | Koide | F02M 35/10039 123/184.21 |
| 7,963,354 | B2 * | 6/2011 | Miyakawa | B62M 7/02 180/218 |
| 8,133,292 | B2 * | 3/2012 | Morita | B62K 11/04 123/198 E |
| 8,137,425 | B2 | 3/2012 | Saito et al. | |
| 8,147,578 | B2 * | 4/2012 | Bannister | B01D 46/2411 123/198 E |
| 8,833,326 | B2 * | 9/2014 | Koyama | F02M 35/162 123/184.57 |
| 9,016,254 | B2 * | 4/2015 | Tanaka | F02M 35/10373 123/184.53 |
| 9,120,524 | B2 * | 9/2015 | Ozaki | B62K 11/04 |
| 2001/0003980 | A1 | 6/2001 | Kawamoto et al. | |
| 2001/0035145 | A1 * | 11/2001 | Utsumi | F02M 35/14 123/184.57 |
| 2004/0060545 | A1 * | 4/2004 | Kurayoshi | F02B 61/02 123/472 |
| 2005/0051375 | A1 * | 3/2005 | Momosaki | F02M 35/10013 180/219 |
| 2005/0205068 | A1 * | 9/2005 | Kurayoshi | F02B 61/02 123/472 |
| 2006/0042603 | A1 * | 3/2006 | Fukami | F02B 17/00 123/472 |
| 2007/0175430 | A1 * | 8/2007 | Yokoi | F02B 27/0231 123/184.55 |
| 2007/0175431 | A1 * | 8/2007 | Yokoi | F02B 27/0231 123/184.55 |
| 2007/0193804 | A1 * | 8/2007 | Yokoi | F02B 27/0231 180/219 |
| 2007/0240667 | A1 * | 10/2007 | Sudoh | F02M 35/10039 123/184.55 |
| 2010/0083928 | A1 | 4/2010 | Saito et al. | |
| 2017/0089307 | A1 * | 3/2017 | Arai | B62M 7/02 |

FOREIGN PATENT DOCUMENTS

| | | | |
|---|---|---|---|
| JP | 59-041664 | 3/1984 | |
| JP | 05026124 A * | 2/1993 | F02B 61/02 |
| JP | 2001-221113 | 8/2001 | |
| JP | 2001-304057 | 10/2001 | |
| JP | 2004-156445 | 6/2004 | |
| JP | 2007-032428 | 2/2007 | |
| JP | 2007-113565 | 5/2007 | |
| JP | 4133229 | 6/2008 | |
| JP | 2010-168902 | 8/2010 | |
| JP | 2011-047381 | 3/2011 | |
| JP | 5284805 | 6/2013 | |

OTHER PUBLICATIONS

Notification of Reason(s) for Rejection dated Oct. 4, 2016 and English Language Summary thereof for corresponding Japan Patent Application No. 2013-110629 (5 pages).

Decision of Grant dated Mar. 7, 2017 for corresponding Japan Patent Application No. 2013-110629 (3 pages).

First Office Action dated Mar. 20, 2017 with English language translation of the Search Report attached to the Office Action for corresponding Chinese Patent Application No. 201480029886.0 (8 pages).

International Search Report for PCT/JP2014/058697, filed Mar. 26, 2014.

Notification of Reason(s) for Rejection dated Jun. 21, 2016 and English Language Summary thereof for corresponding Japan Patent Application No. 2013-110629 (5 pages).

* cited by examiner

AIR CLEANER FOR MOTORCYCLE

CROSS REFERENCE TO THE RELATED APPLICATION

This application is a continuation application, under 35 U.S.C § 111(a) of international application No. PCT/JP2014/058697, filed Mar. 26, 2014, which claims priority to Japanese patent application No. 2013-110629, filed May 27, 2013, the entire disclosure of which is herein incorporated by reference as a part of this application.

BACKGROUND OF THE INVENTION

Field of the Invention

The present invention relates to an air cleaner for a motorcycle which can allow a motorcycle rider to feel an improved acceleration feeling.

Description of Related Art

An air cleaner employed in a motorcycle has hitherto been of a structure in which a cleaner element for capturing foreign matters is disposed in mating interface between a lower casing and a covering member covering upwardly of the lower casing. In this connection, see the patent document 1 listed below. In the case of this conventional air cleaner, at the mating interface, division is made between a dirty chamber for introducing a fresh air thereinto and a clean chamber for introducing a clean air, that is, the air which has been substantially purified by the cleaner element. Further, a funnel member is so disposed as to confront an outlet for the clean air, and a wall partitioning between the funnel side and the dirty chamber side is provided in the lower casing so as to extend to the mating interface.

PRIOR ART LITERATURE

Patent Document 1: JP Laid-open Patent Publication No. 2001-221113

It has, however, been found that according to such a structure as disclosed in the patent document 1, since the capacity of the clean chamber is relatively small as compared with the capacity of the dirty chamber. Also, since the partition wall dividing into the dirty chamber and the clean chamber is of a substantial height, the flow passage from the cleaner element to a air cleaner outlet that is defined in an upstream side opening of the funnel tends to increase. As a result thereof, the sound pressure level of an intake air sound during the acceleration comes to have a peak at two frequencies of about 350 Hz and about 500 Hz. Such sound pressure level do not coincide with the frequency peak (about 400 Hz) of engine sounds generated in the motorcycle and, therefore, the motorcycle rider is unable to appreciate a good acceleration feeling.

SUMMARY OF THE INVENTION

In view of the foregoing, the present invention has for its object to provide an air cleaner for use in the motorcycle, which can allow the motorcycle rider to feel a comfortable acceleration feeling.

The air cleaner herein disclosed in accordance with the present invention is mounted on a motorcycle for purifying an engine intake air. However, in order to accomplish the foregoing object of the present invention, the air cleaner referred to above includes a lower casing forming a cleaner main body, a covering to cover an upward region of the lower casing, a cleaner element disposed inside the lower casing and positioned below a mating interface defined between the lower casing and the covering, and a partition wall formed in the lower casing to support the cleaner element and also to form a portion of a wall of a clean chamber.

According to the present invention, with the cleaner element disposed below the mating interface between the lower casing and the covering, the height of the partition wall can be lowered below the mating interface. Therefore, the intake air flowing through the cleaner element reaches the exit port without flowing markedly around within the covering so as to approach the ceiling surface. Accordingly, the length of the flow passage from the intake port to the exit port of the air cleaner is reduced and the frequency characteristic of the intake air sound can be improved to that having a single peak about 400 Hz. As a result, since the acceleration feeling (increase of the engine power) of the vehicle and the increase of the intake air sound can be made matching with each other, the rider's acceleration feeling can be improved. Also, since the cleaner element is disposed below the mating interface, the capacity of the clean chamber is increased and it can easily pursue a rapid increase of the amount of the intake air entering into the combustion engine. As a result, a rapid accelerating capacity may be rendered to be satisfactory.

In a preferred embodiment of the present invention, an exit port provided in the lower casing may be defined by a funnel mounted on the lower casing, in which case the funnel is disposed on a downstream side of the cleaner element through the partition wall, and a tip end face of the partition wall lies on one side of a major surface of a clean chamber side of the cleaner element adjacent the dirty chamber. According to this structural feature, a tip end face of the partition wall is lowered, in consideration of the cleaner element disposed therebelow, to a position below the cleaner element. Therefore, the clean air which has been purified by the cleaner element can be smoothly guided towards the funnel side on the exit side without the flow thereof towards the exit side being disturbed by the partition wall. As a result thereof, the flow of the intake air flowing considerably around so as to approach the ceiling surface of the covering is eliminated and the flow passage from the intake port to the exit port of the air cleaner is further shortened and, therefore, the improvement of the frequency characteristic of the intake air sound is promoted.

In a further preferred embodiment of the present invention, the exit port provided in the lower casing may be formed by an upstream side opening of the funnel, in which case the exit port protrudes adjacent to the covering rather than to the cleaner element. According to this structural feature, the substantial flow passage from the intake port to the exit port (upstream side opening of the funnel) can be further reduced in length.

The air cleaner preferably includes: a dirty chamber on an upstream side of the cleaner element; a resonant chamber communicated with the dirty chamber on an upstream side of the cleaner element; and a dividing member having a communicating hole and configured to divide between the dirty chamber and the resonant chamber, which resonant chamber is opened to the outside through an air vent hole. According to this structural feature, a high frequency component of the intake air can be amplified by the resonant chamber having the air vent hole, to thereby improve the tone quality of the engine entire sound.

In a different preferred embodiment of the present invention, the cleaner element may be disposed substantially horizontally within the air cleaner, in which case the resonant chamber may exist below the dirty chamber, and the dividing member may extend diagonally upwardly from an intake port defined in the lower casing to reach in the vicinity of an undersurface of the cleaner element. According to these structural features, the fresh air introduced from the intake port of the air cleaner can be smoothly guided towards the cleaner element along the partition member.

In a still further preferred embodiment of the present invention, the cleaner element may include an element main body, made of a filtering material, and a frame to support the element main body, in which case the frame is fitted to the tip end face of the partition wall by means of a screw member. According to this structural feature, selective attachment or detachment of the cleaner element can be accomplished easily.

In a yet further preferred embodiment of the present invention, the lower casing may be formed with a step on which the cleaner element is placed, and the cleaner element can be urged against the step in the lower casing by a plurality of presser projections formed in the covering. According to this structural feature, the cleaner element can be stably supported by the presser projections in the covering.

In a still yet further preferred embodiment of the present invention, the motorcycle may include a head pipe to rotatably support a front fork and a main frame having a front end to which the head pipe is fitted, with the main frame having a pair of left and right main frame pieces, in which case the air cleaner is disposed in the location rearwardly of the head pipe and between the left and right main frame pieces. According to this structural feature, the capacity of the air cleaner can be increased to improve the intake air silencing effect.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Figure 1:
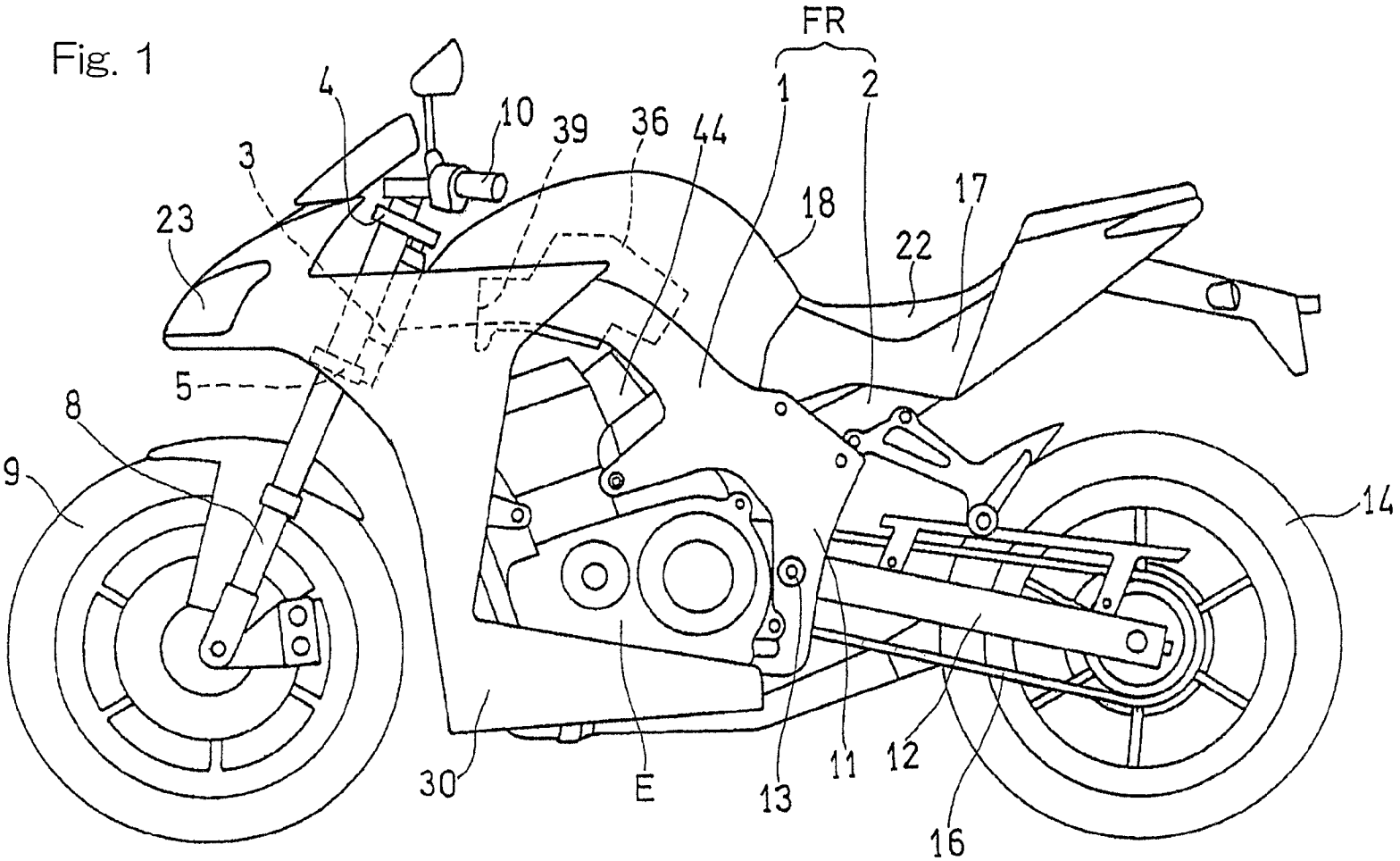
FIG. 1 is a schematic side view of a motorcycle equipped with an air cleaner designed in accordance with a preferred embodiment of the present invention.

A preferred embodiment of the present invention will now be described with particular reference to the accompanying drawings. In particular, FIG. 1 illustrates a schematic side view of a motorcycle in accordance with the preferred embodiment of the present invention. The motorcycle includes a motorcycle frame structure FR made up of a main frame 1, forming a front half portion thereof, and a rear frame 2 connected with a rear portion of the main frame 1 and forming a rear half portion thereof. The main frame 1 has a front end portion to which a head pipe 3 is fitted, and an upper bracket 4 and an under bracket 6 are fitted to a steering shaft (not shown) that is rotatably inserted in the head pipe 3. A front fork 8 is supported by the upper bracket 4 and the under bracket 6, and a front wheel 9 is supported by a lower end portion of the front fork 8. A handlebar 10 is fitted to the upper bracket 4 at an upper end portion of the front fork 8.

The main frame 1 also has a rear end lower portion provided with a swingarm bracket 11, and a swingarm 12 is supported by the swingarm bracket 11 through a pivot pin 13 at a front end portion for movement up and down about such pivot pin 13. A rear wheel 14 is supported by a rear end portion of the swingarm 12. A motorcycle combustion engine E is supported by a lower portion of the main frame 1, and the combustion engine E drives the rear wheel 14 through a power transmission mechanism 16 such as, for example, a substantially endless drive chain. The combustion engine E is, for example, a parallel multi-cylinder, four stroke combustion engine.

A rider's seat 22 is supported on the rear frame 2, and a fuel tank 18 is fitted to an upper portion of the main frame 1, that is, a motorcycle upper portion between the handlebar 10 and the rider's seat 22. A region below the rider's seat 22 is covered by a side covering 17 from lateral outside. A front fairing 30, that is large enough to cover a wide region ranging from a front portion of the motorcycle body to a lateral side of the combustion engine E, is mounted on a motorcycle front portion.

A headlamp unit 23 is mounted on the front fairing 30. An air cleaner 36 is disposed in the vicinity of the rear of the head pipe 3.

Figure 2:
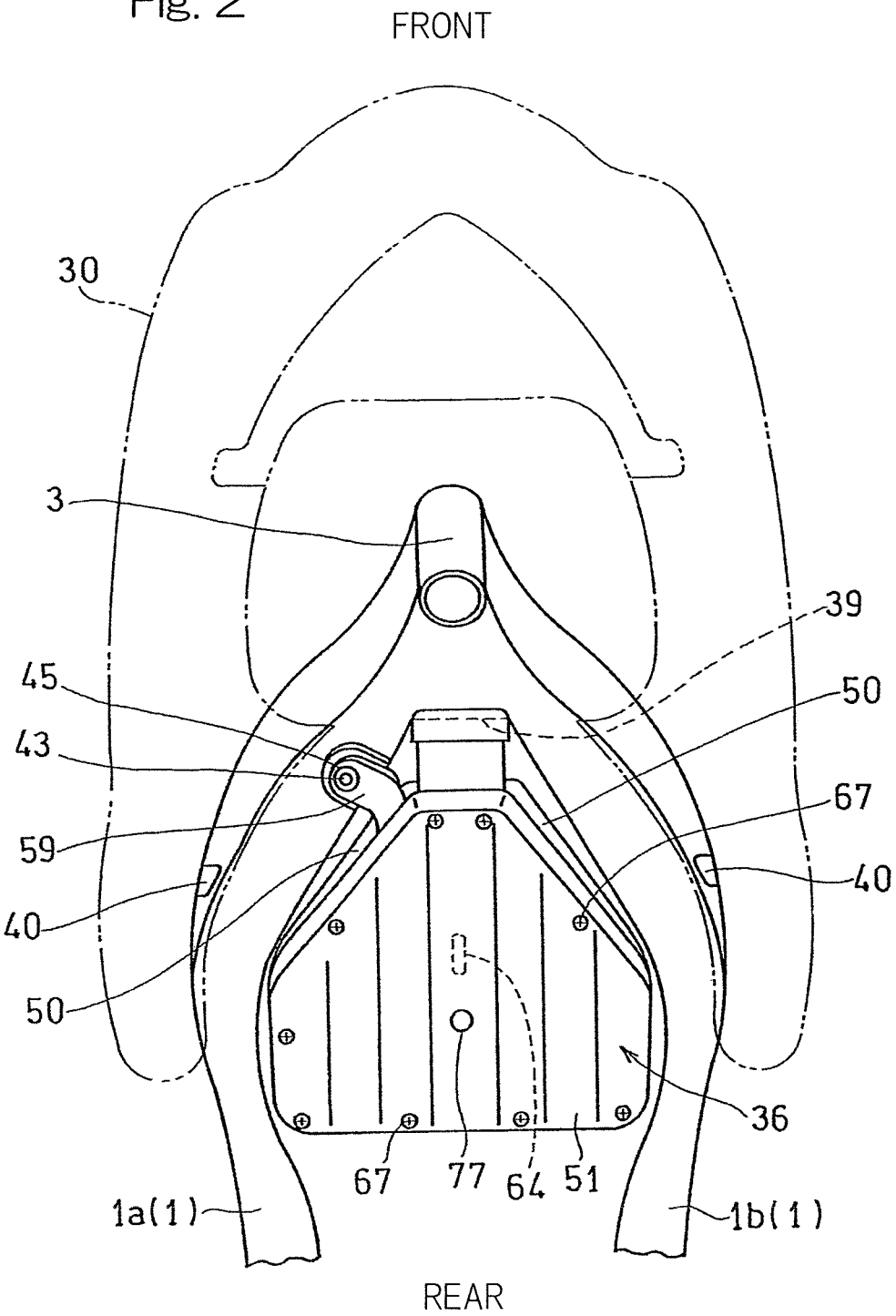
FIG. 2 is a fragmentary top plan view showing, on an enlarged scale, the air cleaner and its neighborhood.

Referring now to FIG. 2, the air cleaner 36 is positioned in the vicinity of the rear of the head pipe 3. The main frame 1 includes a pair of left and right main frame pieces 1*a* and 1*b*, and the air cleaner 36 is disposed intermediate between those frame pieces 1*a* and 1*b*. The air cleaner 36 has a front portion supported by the main frame 1 through a stay 59, which is molded integrally with a lower casing 50 as will be described later, by means of a connecting piece 43 such as, for example, a bolt and a vibration isolating damper (grommet) 45. The air cleaner 36 also has a rear portion supported by a throttle body 44 of the combustion engine E shown in FIG. 1.

Figure 3:
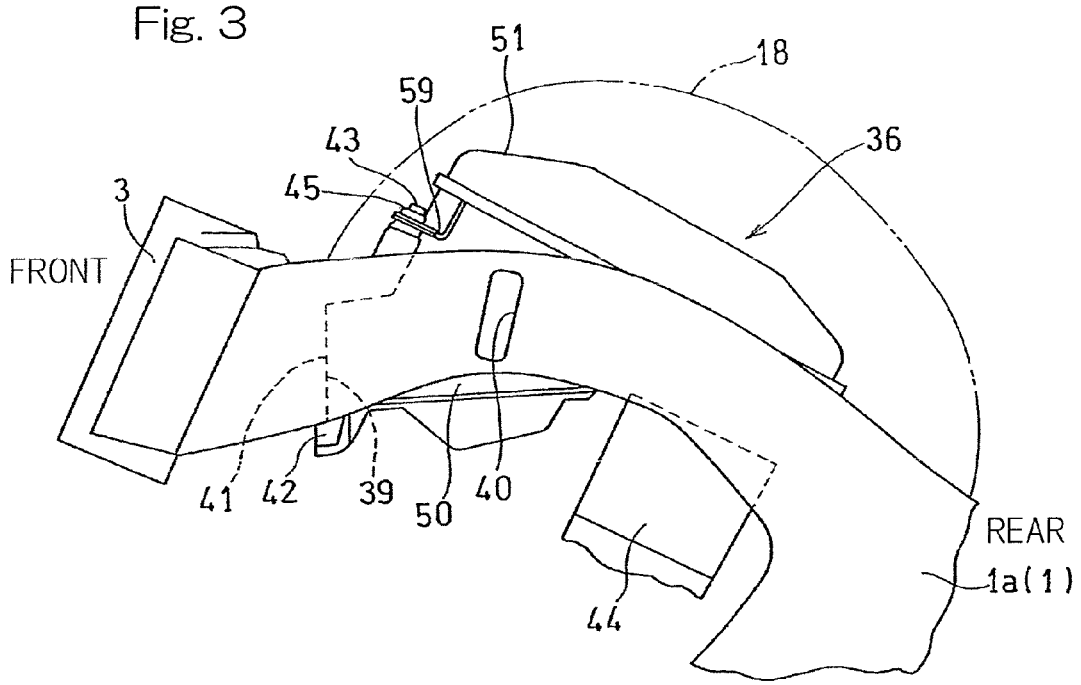
FIG. 3 is a schematic side view showing the air cleaner and its neighborhood.

FIG. 3 illustrates a schematic side view of the air cleaner and its neighborhood. As shown in FIG. 3, a vehicle widthwise direction intermediate part of the front portion of the main frame 1 is provided with an intake air delivery port 39 defined therein so as to open rearwardly such that an incoming wind imported from an intake air introducing port 40, open on an outer side surface of the main frame 1, can be guided through the interior of the main frame 1 to the intake air delivery port 39. The air cleaner 36 has a main intake port (inlet) 41 fluidly connected with the intake air delivery port 39. The air cleaner 36 also includes a sub intake port 42 for importing an additional air, which port 42 is continued with a lower portion of the main intake port 41. The sub intake port 42 protrudes downwardly from the air cleaner 36 and is exposed to the outside of the main intake port 41.

Figure 4:
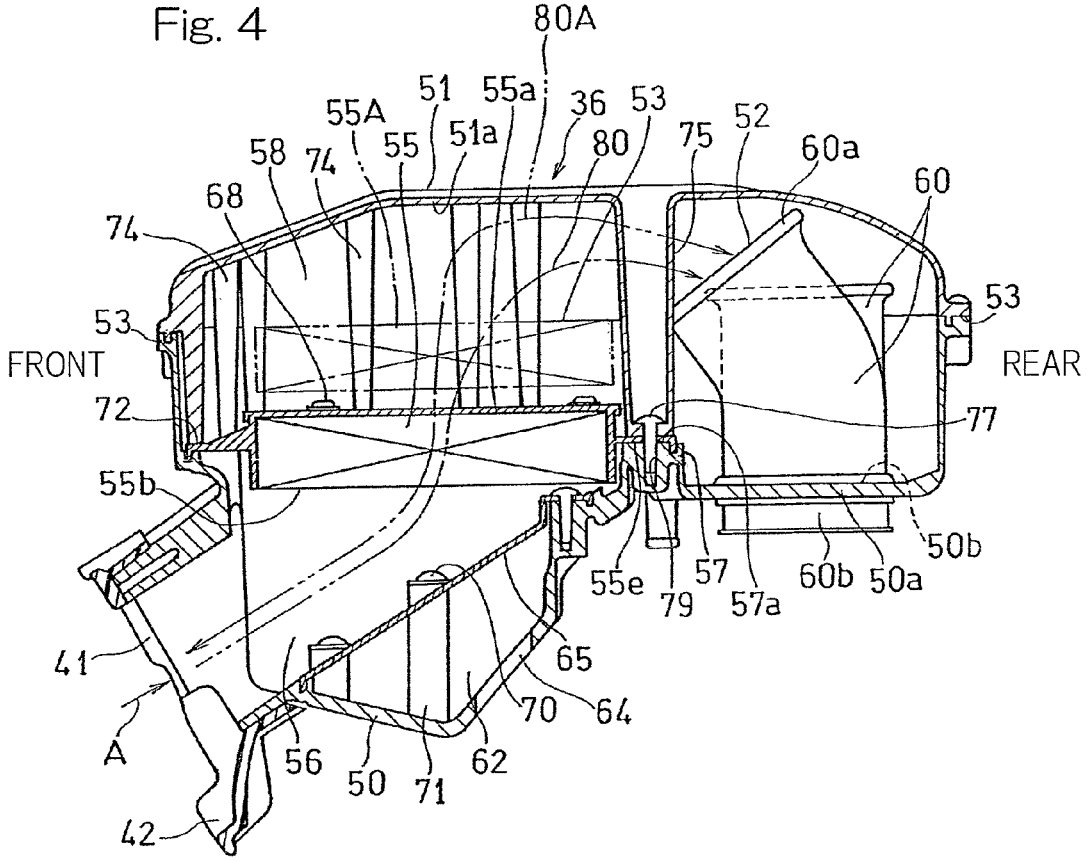
FIG. 4 is a longitudinal sectional view showing the air cleaner and its vicinity.

FIG. 4 illustrates a longitudinal sectional view of the air cleaner. As shown in FIG. 4, the air cleaner 36 includes a lower casing 50 and a covering 51 covering an upper region of the lower casing 50. The lower casing 50 and the covering 51 are both made of a resinous material. The lower casing 50 has its interior in which a cleaner element 55 for purifying an intake air A is accommodated. In the interior of the air cleaner 36, a dirty chamber 56 is defined on an upstream side on one side of the cleaner element 55 and a clean chamber 58 s defined on a downstream side of the cleaner element 55.

The cleaner element 55 is of a flat shape and is disposed below a mating interface 53 defined between the lower casing 50 and the covering 51. In other words, a major surface 55*a* of the clean chamber 58, which is an upper surface of the cleaner element 55, is positioned below the mating interface 53. Also, the major surface 55*a* is set to lie substantially parallel to the mating interface 53. A partition wall 57 for supporting a rear portion of the cleaner element 55 and forming a part of the wall of the cleaner chamber 58 is integrally formed with the lower casing 50 at a location rearwardly of the cleaner element 55.

An exit port 52 provided in the lower casing 50 is formed by an upstream side opening 60*a* of a funnel 60 mounted on the lower casing 50, and the funnel 60 is disposed on a further downstream side of the partition wall 57 on an downstream side of the cleaner element 55. The funnel 60 is made of a rubber material and is employed one for each of the cylinders of the combustion engine E and, hence, the four funnels 60 are employed in the practice of this embodiment now under discussion. Those funnels 60 occupy respective positions aligned in a row parallel to the motorcycle widthwise direction, and the base portions 60*b* on a downstream side of the funnel 60 are engaged in corresponding mounting holes 50*b* defined in a bottom wall 50*a* of the lower casing 50. The partition wall 57 has a tip end face 57*a* positioned below the major surface 55*a* on the clean chamber side of the cleaner element 55, that is, adjacent the dirty chamber 56, and the exit port 52 protrudes upwardly of the cleaner element 55, that is, towards the covering 51.

A resonant chamber 62 communicated with the dirty chamber 56 is provided on an upstream side of the cleaner element 55. The dirty chamber 56 and the resonant chamber 62 are divided from each other by a dividing member 65 having at least one communicating hole 63 (shown in FIG. 6). Also, a portion of the lower casing 50, which forms a bottom wall of the resonant chamber 62, is formed with a slit shaped air vent hole 64, extending in a forward and rearward direction or longitudinal direction of the motorcycle body, is formed at a substantially intermediate portion of the motorcycle widthwise direction. The resonant chamber 62 is disposed below the dirty chamber 56, and the flat cleaner element 56 is horizontally disposed so as to confront upwardly of the resonant chamber 62. The dividing member 65 referred to above extends diagonally upwardly from the intake port 41 to a position in the vicinity of an undersurface 55*b* of the cleaner element 55.

Figure 5:
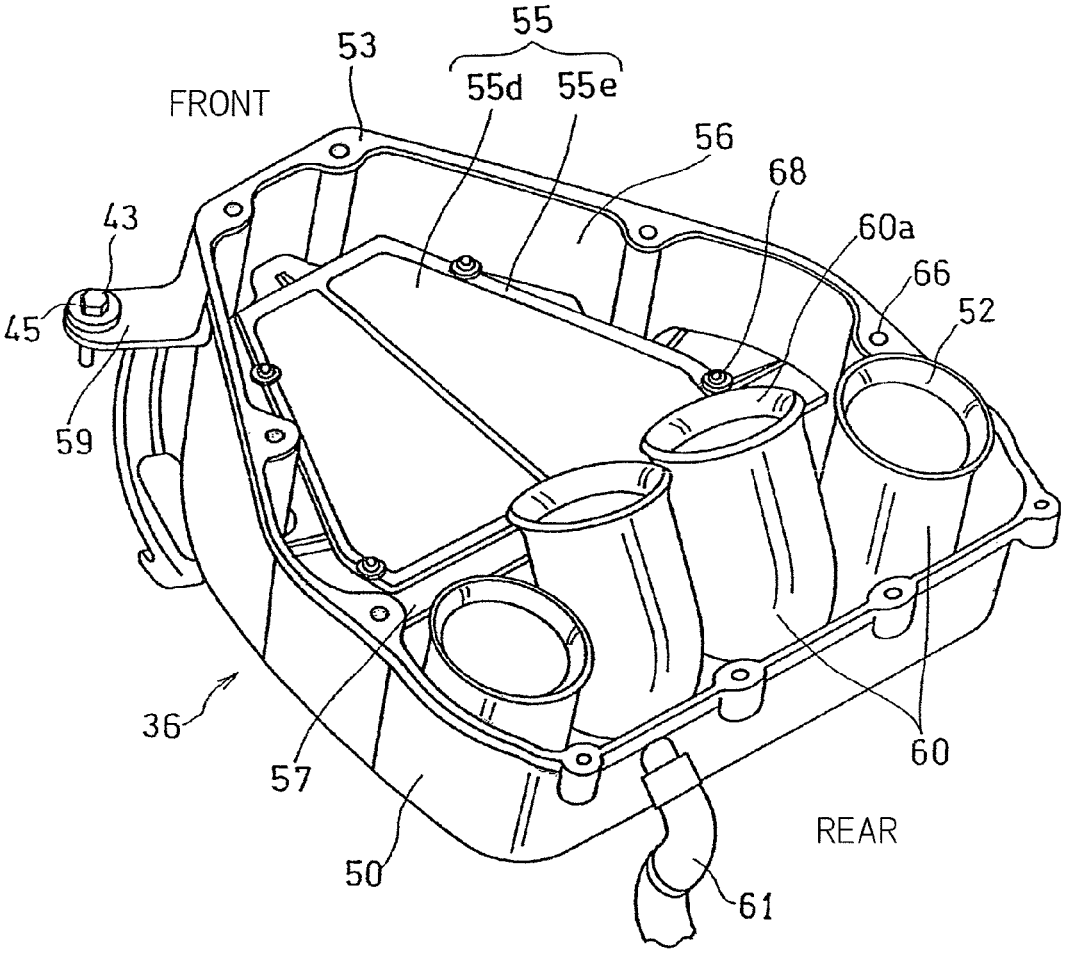
FIG. 5 is a perspective view showing the air cleaner with a covering for the air cleaner being removed, with air cleaner as viewed from diagonally rearwardly and upwardly.

FIG. 5 illustrates a perspective view of the air cleaner with the covering for the air cleaner being removed, with air cleaner shown as viewed from diagonally rearwardly and upwardly. As shown in FIG. 5, when the covering 51 for the air cleaner 36 is removed, the cleaner element 55 is brought in an exposed condition. The cleaner element 55 includes an element main body 55*d*, made of a filtering material such as, for example, a urethane foam, and a frame 55*e* for supporting the element main body 55*d*. The frame 55*e* is fitted to an inner side of the lower casing 50 by means of a plurality of screw members 68.

The mating interface 53 between the covering 51 and an outer periphery of the lower casing 50 is provided with a plurality of threaded holes 66 spaced at a predetermined distance from each other. By threading screw members 67, inserted into the covering 51, shown in FIG. 2, into the threaded holes 66, the covering 51 is fitted to the lower casing 50. The lower casing 50 has a rear portion connected with a breather pipe 61 of the combustion engine E.

Figure 6:
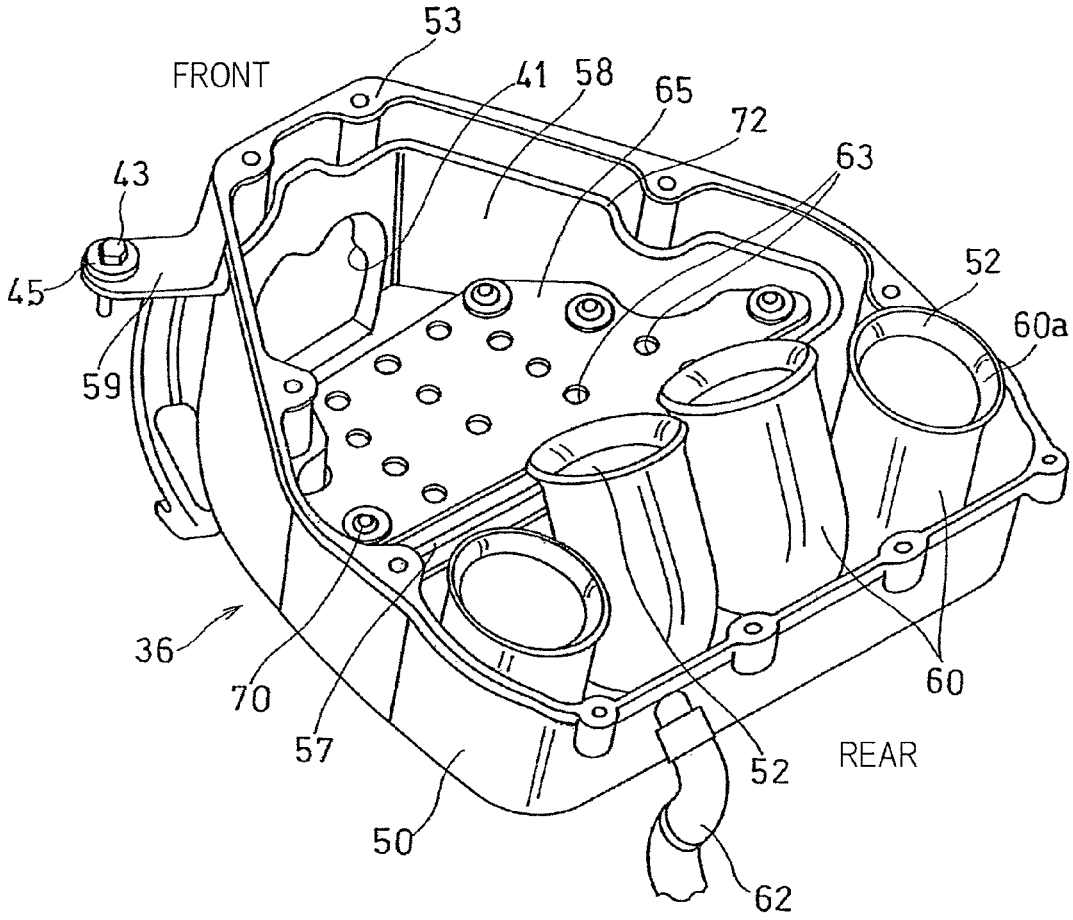
FIG. 6 is a perspective view showing the air cleaner with a cleaner element being removed, with air cleaner as viewed from diagonally rearwardly and upwardly.

FIG. 6 is a perspective view of the air cleaner with the cleaner element being removed, with the air cleaner shown as viewed from diagonally upwardly and rearwardly. As shown in FIG. 6, the dividing member 65 provided with a plurality of communicating holes 63 is disposed so as to extend from a lower end of the air intake port 41, provided in a lower front of the air cleaner 36, to a position in the vicinity of the partition wall 57. The dividing member 65 has its peripheral edge fitted to a mounting portion 71 (shown in FIG. 4), which protrudes from an inner wall of the lower casing 50, by means of a connecting member 70. Also, the lower casing 50 has an outer peripheral wall, and a step 72 for supporting the cleaner element 55 is formed in an inner surface of the outer peripheral wall of the lower casing 50. The cleaner element 55 shown in FIG. 5 is placed on this step 72. The tip end face 57*a* of the partition wall 57 shown in FIG. 4 is formed by a portion of the step 72.

The frame 55*e* has an upper surface that is urged against the step 72 by means of a plurality of presser projections 74 formed integrally with the covering 51. A single presser piece 75 is formed in the covering 51 at a location rearwardly of the cleaner element 55. By a lower end face of the presser piece 75, the frame 55*e* of the cleaner element 55 is urged against the tip end face 57*a* of the partition wall 57 and, by threading a screw member 77, inserted into a hollow of the presser piece 75, into a threaded hole 79 formed in the partition wall 57, the frame 55*e* is fitted to the partition wall 57.

The air cleaner 36 of the structure hereinabove described is such that the cleaner element 55 is disposed below the mating interface 53 between the lower casing 50 and the covering 51 and, accordingly, as shown by the following Table 1, the clean chamber 58 has come to have an area larger than that in the conventional air cleaner.

TABLE 1

| Capacity (liter) | Conventional | Invention |
|---|---|---|
| Clean Chamber 58 | 5.1 | 6.3 |
| Sum of Dirty Chamber 56 and Resonant Chamber 62 | 2.7 | 1.8 |
| Volume Ratio | 1.9 | 3.5 |

In this instance, since the resonant chamber 62 is communicated with the dirty chamber 56 to form a part of a space of the dirty side, the sum of the capacities of the dirty chamber 56 and the resonant chamber 62 are contradistinguished with the capacity of the clean chamber 58 in the table above. It is to be noted that the volume ratio of the dirty chamber 56 and the resonant chamber 62 is 1.1:0.7. As a result of experiments, the ratio (the volume ratio at the bottom of the table above) between the capacity of the clean chamber 58 and the sum of the respective capacities of the dirty chamber 56 and the resonant chamber 62 is preferably within the range of 3:1 to 4:1, which has been proven to be feasible in terms of the frequency characteristic of the intake air sound and the air intake efficiency.

In the construction hereinabove described, since the cleaner element 55 as shown in FIG. 4 is disposed below the mating interface 53, the height of the partition wall 57 can also be made lower than the mating interface 53. Therefore, the flow passage from the intake port 41 to the exit port 51 of the air cleaner 36 is rendered to be short. In other words, according to the conventional art, as shown by the double dotted line, the cleaner element 55A has an upper surface coinciding with the mating interface 53. Therefore, the intake air A flowing through the cleaner element 55A flows into an upstream side opening 60*a* (exit port 52) of the funnel 60 after having flown markedly around so as to approach a ceiling surface 51*a* of the covering 51 as shown by the flow line 80A indicated by the double dotted line. As a result thereof, the flow passage from the intake port 41 to the exit port 52 of the air cleaner 36 has been long.

In contrast thereto, according to the above described embodiment, since the cleaner element 55 and the partition wall 57 are set to be lower than the mating interface 53, as shown by the flow line 80 indicated by the solid line, the flow of the intake air A around towards the ceiling surface 51*a* is suppressed and therefore, the flow passage is rendered to be short. Accordingly, the frequency characteristic of the intake air sound could have been changed to that having a single peak. As a result, since the acceleration feeling (increase of the engine power) of the vehicle and the increase of the intake air sound can be made matching with each other, the rider's acceleration feeling can be improved. Also, since the cleaner element 55 is disposed below, the capacity of the clean chamber 58 is increased. Therefore, it can easily pursue a rapid increase of the amount of the intake air by the combustion engine and, hence, a rapid accelerating capacity is increased.

On this occasion, even though the position of the mating interface 53 is lowered and the cleaner element 55 is aligned with this position of the mating interface 53, the position of the element 55 can be lowered. In such case, however, the shape of the lower casing 50 may change correspondingly and, therefore, a relation of connection with peripheral component parts such as, for example, a breather pipe 61 (shown in FIG. 5) may alter to such an extent as to result in a considerable change in designing. Therefore, this is indeed undesirable.

Also, the exit port 52 provided in the lower casing 50 is defined by the funnel 60 mounted on the lower casing 50, the funnel 60 is disposed on the further downward side of the partition wall 57 at the downstream side of the cleaner element 55, and the tip end face 57*a* is positioned closer to the dirty chamber 56 than to the major surface 55*a* of the clean chamber side of the cleaner element. Accordingly, since the partition wall 57 comes to a position further lower than the cleaner element 55 which has been lowered, the clean air purified by the cleaner element 55 can be smoothly guided towards the exit port 52 side without being disturbed by the partition wall 57. As a result, the flow path along the flow line 80 from the intake port 41 to the exit port 52 of the air cleaner 36 is further lowered.

Also, the exit port 52 provided in the lower casing 50 is formed by the upstream side opening 60*a* of the funnel 60 and the exit port 52 protrudes adjacent to the covering 51 rather than to the cleaner element 55, that is, upwardly of the lower casing 50. Accordingly, a substantial flow path from the intake port 41 to the exit port 52 of the air cleaner 36 can be further shortened.

Moreover, provided is the resonant chamber 62 communicated with the dirty chamber 56 on the upstream side of the cleaner element 55, the dirty chamber 56 and the resonant chamber 62 are separated by the dividing member 65 having the communicating hole 63 therebetween, and the resonant chamber 62 is opened to the outside of the air cleaner 36 through the air vent hole 64. Accordingly, a high frequency component of the intake air sound is amplified to improve the tone quality of the engine entire sounds.

In addition, the cleaner element 55 is disposed substantially horizontally within the air cleaner 36, the resonant chamber 62 exists below the dirty chamber 56, and the dividing member 65 extends diagonally upwardly from the intake port 41 to reach in the vicinity of the undersurface 55*b* of the cleaner element 55. Accordingly, the fresh air introduced through the intake port 41 of the air cleaner 36 can be guided smoothly along the dividing member 65.

Yet, the cleaner element 65 includes the element main body 55*d* and the frame 55*e* for supporting the element main body 55*d*, and the frame 55*e* is fitted to the tip end face 57*a* of the partition wall 57 by means of the screw member 77. Accordingly, selective mounting or detachment of the cleaner element 55 can be easily accomplished.

Furthermore, since the cleaner element 55 is urged against the step 72 in the lower casing 50 by a plurality of presser projections 74 formed in the covering 51, the cleaner element 55 can be stably supported.

Finally, since the air cleaner 36 is disposed in the location rearwardly of the head pipe 3 and between the left and right main frame pieces 1*a* and 1*b*, the capacity of the air cleaner 36 can be increased to improve the intake air silencing effect.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

30 . . . Fairing
36 . . . Air cleaner
41 . . . Intake port
50 . . . Lower casing
51 . . . Covering
51*a* . . . Ceiling surface
52 . . . Exit port
53 . . . Mating interface
55 . . . Cleaner element
55*a* . . . Major surface
55*b* . . . Undersurface
56 . . . Dirty chamber
57 . . . Partition wall
57*a* . . . Tip end surface
58 . . . Clean chamber

60 . . . Funnel
62 . . . Resonant chamber
63 . . . Communicating hole
64 . . . Air vent hole
65 . . . Dividing member
A . . . Intake air

What is claimed is:

1. An air cleaner mounted on a motorcycle to purify an engine intake air, which air cleaner comprises:

a lower casing to form a cleaner main body;

a covering to cover an upward region of the lower casing;

a cleaner element disposed inside the lower casing and positioned below a mating interface defined between the lower casing and the covering;

a partition wall formed in the lower casing to support the cleaner element and also to form a portion of a wall of a clean chamber;

a dirty chamber formed in the lower casing and disposed on an upstream side of the cleaner element;

a resonant chamber communicated with the dirty chamber on the upstream side of the cleaner element; and a plate-like dividing member having a plurality of circular communicating holes and configured to divide between the dirty chamber and the resonant chamber, the resonant chamber being opened to the outside through a slit shaped air vent hole extending in a longitudinal direction of a motorcycle body; wherein the air vent hole is formed at an intermediate portion, of the resonant chamber, in a motorcycle widthwise direction.

2. The air cleaner for the motorcycle as claimed in claim 1, further comprising:

four exit ports provided in the lower casing; and four funnels mounted on the lower casing and disposed on a downstream side of the cleaner element through the partition wall, wherein:

the four exit ports are defined by the respective funnels, and the exit ports protrude adjacent to the covering rather than to the cleaner element;

each of the four funnels is disposed on a downstream side of the cleaner element through the partition wall;

a tip end face of the partition wall lies on one side of a major surface of a clean chamber side of the cleaner element adjacent the dirty chamber;

the four funnels are aligned in a row parallel to a motorcycle widthwise direction; and two of the four funnels, which are arranged at a central portion in the motorcycle widthwise direction, are longer than the other two of the four funnels which are arranged outside in the motorcycle widthwise direction.

3. The air cleaner for the motorcycle as claimed in claim 1, in which an exit port provided in the lower casing is formed by an upstream side opening of the funnel, and the exit port protrudes adjacent to the covering rather than to the cleaner element.

4. The air cleaner for the motorcycle as claimed in claim 1, in which:

the cleaner element is disposed substantially horizontally within the air cleaner;

the resonant chamber exists below the dirty chamber;

the dividing member extends diagonally upwardly from an intake port defined in the lower casing to reach in the vicinity of an undersurface of the cleaner element the resonant chamber is foamed by a portion of the lower casing; and the intake port is provided in a lower front of the air cleaner.

5. The air cleaner for the motorcycle as claimed in claim 1, in which the cleaner element comprises:

an element main body, made of a filtering material; and a frame to support the element main body, the frame being fitted to the tip end face of the partition wall by means of a screw member.

6. The air cleaner for the motorcycle as claimed in claim 1, in which:

the lower casing is formed with a step on which the cleaner element is placed; and the cleaner element is urged against the step in the lower casing by a plurality of presser projections formed in the covering.

7. The air cleaner for the motorcycle as claimed in claim 1, which motorcycle further comprises:

a head pipe to rotatably support a front fork; and a main frame having a front end to which the head pipe is fitted, the main frame including a pair of left and right main frame pieces, in which the air cleaner is disposed in a location rearwardly of the head pipe and between the left and right main frame pieces.

* * * * *